US007083322B2

(12) United States Patent
Moore et al.

(10) Patent No.: US 7,083,322 B2
(45) Date of Patent: Aug. 1, 2006

(54) COATING PRODUCTION SYSTEMS AND METHODS WITH ULTRASONIC DISPERSION AND ACTIVE COOLING

(75) Inventors: Stephen G. Moore, Renton, WA (US); Kevin R. Malone, Renton, WA (US); James C. McGarvey, Issaquah, WA (US)

(73) Assignee: The Boeing Company, Chicago, IL (US)

( * ) Notice: Subject to any disclaimer, the term of this patent is extended or adjusted under 35 U.S.C. 154(b) by 153 days.

(21) Appl. No.: 10/725,146

(22) Filed: Dec. 1, 2003

(65) Prior Publication Data

US 2005/0117447 A1 Jun. 2, 2005

(51) Int. Cl.
*B01F 11/02* (2006.01)

(52) U.S. Cl. ..... 366/118; 366/136; 366/139; 366/145; 366/148; 366/605

(58) Field of Classification Search ..... 366/118, 366/127, 136, 137, 139, 144, 145, 148, 149, 366/605; 62/118
See application file for complete search history.

(56) References Cited

U.S. PATENT DOCUMENTS 1,781,648 A * 11/1930 Mapother ..... 106/262
3,421,477 A * 1/1969 Gilbert ..... 118/602
4,403,866 A * 9/1983 Falcoff et al. ..... 366/132
5,874,167 A 2/1999 Rawlings et al.
6,177,189 B1 1/2001 Rawlings et al.
6,191,248 B1 2/2001 Rawlings et al.
6,380,264 B1 * 4/2002 Jameson et al. ..... 516/21
6,438,998 B1 8/2002 Oh et al.

OTHER PUBLICATIONS

Article: Ultrasonic Dispersion of Pigment in Water Based Paints, by James O. Stoffer and Maher Fahim, University of Missouri-Rolla, Journal of Coatings Technology, vol. 63, No. 797, Jun. 1991, 9 pages.

* cited by examiner

*Primary Examiner*—David Sorkin
(74) *Attorney, Agent, or Firm*—Harness Dickey & Pierce P.L.C.

(57) ABSTRACT

Coating production systems and methods which include ultrasonic dispersion and active cooling. The system includes a mixing reservoir and an ultrasonic disperser for ultrasonically dispersing an additive with another coating component within the mixing reservoir. The system also includes a heat exchanger in communication with the mixing reservoir to receive a mixture of the additive and another coating component from the mixing reservoir. The mixture is cooled by thermal energy transfer from the mixture to the heat exchanger. The cooled mixture is returned to the mixing reservoir.

30 Claims, 2 Drawing Sheets

COATING PRODUCTION SYSTEMS AND METHODS WITH ULTRASONIC DISPERSION AND ACTIVE COOLING

FIELD OF THE INVENTION

The present invention relates generally to the production of coatings, and more particularly to coating production systems and methods which include ultrasonic dispersion and active cooling.

BACKGROUND OF THE INVENTION

Certain "high-performance" coating applications, such as some aerospace paints, require specific pigment morphology, shapes, and sizes. In order for the coating produced therewith to perform adequately, the pigments and other additives must be properly dispersed yet not be damaged. Many conventional dispersion processes, however, can alter the required pigment morphology, which, in turn, can degrade the performance of the resulting coating product.

SUMMARY OF THE INVENTION

The present invention relates to coating production systems and methods which include ultrasonic dispersion and active cooling. In a preferred embodiment, the system for producing a coating generally includes a mixing reservoir and an ultrasonic disperser for ultrasonically dispersing an additive (e.g., pigment particles, colorants, combination thereof, etc.) with another coating component (e.g., binder, solvent, resin carrier, combination thereof, etc.) within the mixing reservoir. The system also includes a heat exchanger in communication with the mixing reservoir to receive a mixture of the additive and another coating component from the mixing reservoir. The mixture is cooled by thermal energy transfer from the mixture to the heat exchanger. The cooled mixture is returned to the mixing reservoir. Accordingly, the active cooling by the heat exchanger allows the mixture to be maintained within a desired temperature range.

In another preferred embodiment, a method of producing a coating generally includes receiving a coating component within a mixing reservoir, receiving an additive within the mixing reservoir, ultrasonically dispersing the additive with the coating component within the mixing reservoir, and actively cooling a mixture of the additive and coating component by allowing thermal energy transfer therefrom. The active cooling allows the mixture to be preferably maintained within a desired temperature range.

The features, functions, and advantages can be achieved independently in various embodiments of the present inventions or may be combined in yet other embodiments.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
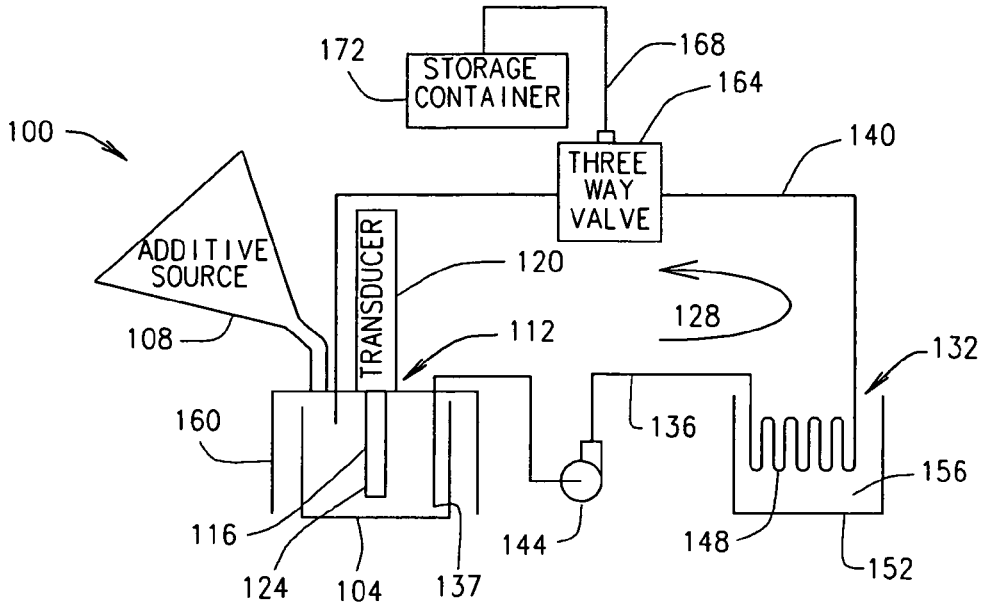
FIG. 1 is a schematic of a coating production system according to an embodiment of the invention.

An exemplary system embodying several aspects of the invention is illustrated in FIG. 1 and is indicated generally by reference character 100. As shown in FIG. 1, the system 100 includes a mixing reservoir or tank 104 in which an additive(s) (e.g., pigment particles, colorants, resin, etc.) can be mixed with one or more other coating components (e.g., binders, resin carriers, solvents, etc.) to produce a wide range of coatings.

In some embodiments, the mixing reservoir 104 includes a disposable liner. During operation of the system 100, the liner is positioned within the reservoir 104 to prevent the coating and components thereof from directly contacting the reservoir 104. After the contents of the mixing reservoir 104 have been removed, the disposable liner can be removed from the reservoir 104 and appropriately disposed. Accordingly, the liner can thus eliminate (or at least reduce) the amount of time, labor, and cleansing chemicals (e.g., solvents) otherwise needed for cleaning up the reservoir 104 after the coating has been removed therefrom.

The disposable liner is preferably formed of plastic. Alternatively, other relatively inexpensive (i.e., disposable) materials which are impermeable to the particular coating being produced can also be used for the liner.

During operation of the system 100, the mixing reservoir 104 can also preferably function as a vacuum chamber. Exemplary embodiments includes sealing the system 100, placing the system 100 under a vacuum, preferably of at least about 29" Hg and above, and then maintaining the system 100 at the reduced pressure at least until the mixing process is completed.

By way of example, a vacuum pump can be connected to the system 100 for reducing the system pressure. Alternatively, other sources of low pressure can also be employed. For example, another embodiment includes a venturi vacuum generator connected to the system and to a source of air, such as an air compressor or pump. The vacuum generator includes a venturi nozzle which receives air from the air compressor or pump connected to the vacuum generator. As air travels through the venturi nozzle, the velocity of the air increases and the pressure within the venturi nozzle decreases. This pressure decrease causes fluid (e.g., air, vapors, etc.) to be drawn or pulled out of the system into the vacuum generator, thereby placing the system under a vacuum.

Figure 2:
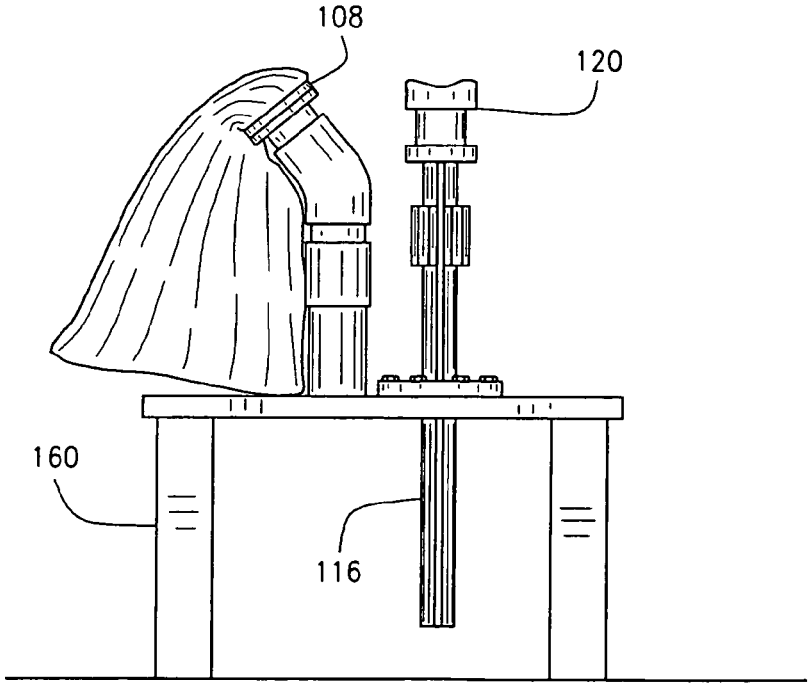
FIG. 2 is a perspective view of a sonotrode, a transducer, a additive source and support assembly of the system shown in FIG. 1.
Figure 3:
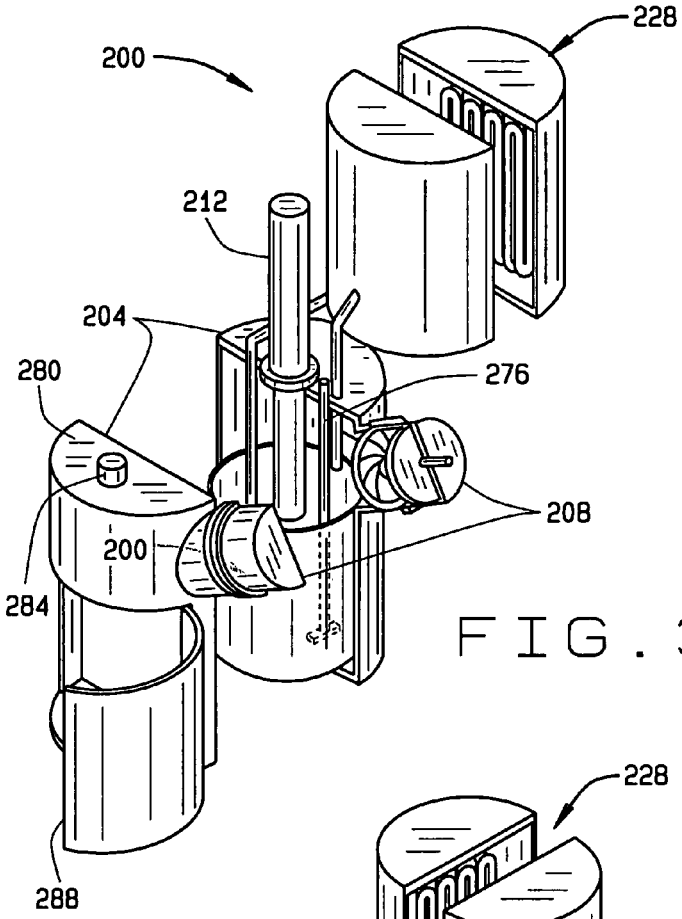
FIG. 3 is an exploded perspective view of a coating production system according to another embodiment of the invention.
Figure 4:
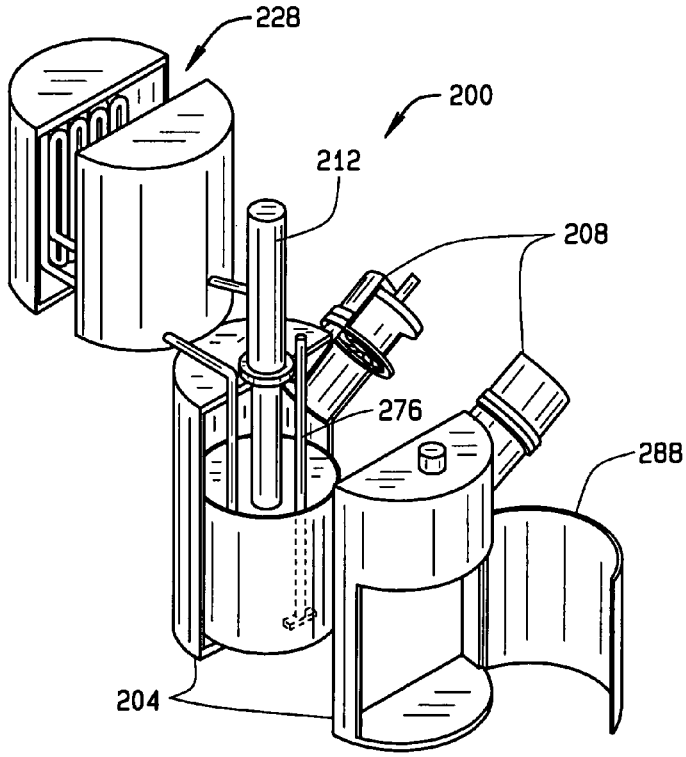
FIG. 4 is another exploded perspective view of the coating production system shown in FIG. 3.

With reference to FIGS. 1 and 2, the system 100 includes an additive source 108 from which the mixing vessel 104 receives an additive, such as pigment particles. The source 108 can take on various forms such as a hopper (FIG. 1), a filler tube (FIG. 2), and/or a powder hopper with an Iris valve and ram (FIGS. 3 and 4).

Referring back to FIGS. 1 and 2, the system 100 further includes an ultrasonic disperser 112 for ultrasonically dispersing and mixing the additive with the one or more other coating components (e.g., binder, solvent, resin, etc.) within the mixing vessel 104. In the illustrated embodiment, the ultrasonic disperser 112 comprises a sonotrode 116 (e.g., a four kilowatt sonotrode, etc.) and a transducer 120 which applies energy to the sonotrode 116. Alternatively, other suitable ultrasonic dispersion systems can be employed.

In one embodiment, the sonotrode 116 is translatable relative to the mixing reservoir 104. The translatability of the sonotrode 116 facilitates handling of the mixing vessel 104 and final cleanup.

In addition, the translatability also allows at least a distal end portion 124 of the sonotrode 116 to be immersed within the coating component(s) within the mixing reservoir 104. This allows the ultrasonic energy produced by the sonotrode 116 to propagate through the coating component(s) within the mixing reservoir 104. The propagating ultrasonic energy causes the additive particles to disperse and mix with the coating component(s) in the mixing reservoir 104. Preferably, the sonotrode 116 and mixing reservoir 104 are positioned relative to one another such that the sonotrode 116 is positioned at about a center of the mixing reservoir 104. In addition, control of the time and amplitude of the ultrasonic energy produced by the sonotrode 116 is preferably automated or under automatic computer control.

By using ultrasonic dispersion, the present invention significantly improves dispersion and mixing of additive particles. This, in turn, improves color expression and overall coating performance of the resulting paint or other coating product. Further, ultrasonic dispersion also generates very finely dispersed particles without damaging the delicate particles and in a much shorter time than conventional high shear rate ball milling.

While advantageous, ultrasonic dispersion is associated with a relatively high energy input that can significantly and rapidly increase the temperature of the mixture (e.g., resin/pigment mixture, etc.) within the mixing reservoir 104. If not accommodated, heat generated from the ultrasonic energy input can alter and degrade the morphology or desired function of the additive. In some instances, excessive heat can change the color or shade of colorants or pigment particles. Accordingly, embodiments of the invention include active cooling to remove at least some of the thermal energy or heat produced by the ultrasonic dispersion. The active cooling allows the additive/coating component mixture to be preferably maintained within a desired temperature range. The desired temperature range for a particular application will depend in large part upon the specific coating components being mixed to produce the coating.

As shown in FIG. 1, the system 100 includes a cooling circuit or loop generally indicated by arrow 128. In the exemplary embodiment, the cooling circuit 128 includes a heat exchanger 132, a first conduit 136 for delivering a mixture of the additive and other coating component(s) from the mixing reservoir 104 to the heat exchanger 132, and a second conduit 140 for returning the cooled mixture from the heat exchanger 132 back to the mixing reservoir 104. Preferably, the inlet 137 of the recirculation inlet line 136 is positioned so as to minimize, or at least reduce, liquid holdup in the dispersing vessel 104.

The system 100 also includes a pump 144 for urging fluid flow from the mixing reservoir 104, through the conduits 136, 140 and heat exchanger 132, and back to the mixing reservoir 104. In the illustrated embodiment, the pump 144 comprises a diaphragm pump in communication with the first conduit 136. Alternatively, other suitable pumps can be employed and at other locations along the cooling loop 128.

In the illustrated embodiment, the heat exchanger 132 includes a heat exchange coil 148. The coil 148 is positioned within a bath or container 152 filled with a relatively cold or chilled fluid or coolant 156. Preferably, the heat exchange coil 148 is immersed within the coolant 156, which isolates the mixture from possible aqueous condensates.

Accordingly, temperature of the mixture can be controlled and maintained within a desired temperature range by controllably varying the flow rate of the mixture through the coolant loop 128. Control of the flow rate is preferably automated or under automatic computer control.

The coolant 156 may comprise any of a wide range of fluids, such as water, oil, air, among others, that are suitable for the intended application. It should be noted, however, that the coolant 156 should be non-reactive to the material or materials from which the heat exchange coil 148 is formed. The coolant 156 must also be cooler than the temperature of the mixture flowing through the heat exchange coil 148.

In an exemplary embodiment, the coolant 156 comprises an ethylene glycol/water mixture at a temperature between about negative two degrees Celsius and two degrees Celsius.

In at least some embodiments, the coolant 156 surrenders thermal energy to the surrounding atmosphere. Alternatively, the heat exchanger 132 can be a closed loop which is hermetically sealed such that the coolant 156 is completely contained and not open to the surrounding atmosphere.

Optionally, the system 100 may include a recuperator or heat recovery unit (not shown) for recovering heat from the coolant 156, and or other components of the system 100. The heat recovered by the recuperator can be utilized by the system 100 as process heat.

In a preferred embodiment, the various components 132, 136, 140, 144, 148, 152 comprising the cooling loop 128 are configured to maintain the mixture at approximately room temperature (i.e., 70° F. (21° C.)). Indeed, it has been observed through generally continuous temperature monitoring of the system 100 that maximum energy for ultrasonic dispersion can be input into the system 100 while still maintaining the mixture at about room temperature.

It should be noted that the components comprising the cooling loop 128 should be designed in accordance with the constraints of the particular system embodiment in which they will be used. Additionally, the particular flow characteristics and heat transfer capabilities will vary according to the design requirements of the particular system. In some embodiments, the size of the heat exchange surface area and chiller capacity are sized according to the energy input from the sonotrode 116. Further, the particular configuration of the heat exchange coil 148 shown in FIG. 1 is merely illustrative of one exemplary embodiment, and other coil configurations can be employed depending on the particular application.

In operation, the system 100 can be used as follows. Preferably, the system 100 is sealed and placed under a vacuum. In a preferred embodiment, the system 100 is placed under a vacuum of at least 29" Hg or above. The system 100 is preferably maintained at a reduced pressure at least until the mixing process is completed. Placing the system 100 under a vacuum can prevent (or at least reduce the amount of) air from being mixed into the coating. For certain types of additives, the placement of the system 100 under a vacuum can prevent (or at least reduce the extent of) additives from oxidizing and/or reacting with the air (e.g., pyrophoric metal fillers, etc.).

The coating component(s) (e.g., binder, solvent, carrier, resin solvent combinations, other base matrixes etc.) are then added to the mixing reservoir 104. The pump 144 may be activated to urge fluid flow from the mixing reservoir 104 through the cooling loop 128. The sonotrode 116 immersed in the resin is activated and produces ultrasonic energy that propagates through the coating component(s) within the mixing reservoir 104.

The additive (e.g., pigment particles, filler, colorant, etc.) from the source 108 can be allowed to degas (e.g., through vacuum de-aeration, etc.) prior to being admixing with the other coating component(s) in the mixing reservoir 104. After degassing, the additive is added to the mixing tank 104.

As the additive is admixed with the other coating component(s), the intense ultrasonic energy disperses or breaks up the agglomerated additive particles resulting in an extremely fine dispersion of additive particles within the coating component(s) in the mixing reservoir 104. Although it is preferable to add the additive to the mixing reservoir 104 while the coating component(s) therein is agitating due to the ultrasonic energy produced by the sonotrode 116, such is not required.

A mixture from the mixing reservoir 104 is pumped through the cooling loop 128. That is, the mixture flows through the first conduit 136, the heat exchange coil 148, the second conduit 140, and is ultimately returned to the mixing reservoir 104. As the mixture flows through the heat exchange coil 148, the mixture transfers thermal energy to the fluid 156 in which the heat exchange coil 148 is immersed. In addition, heat can be transferred from the mixture through the conduits 136, 140 to the air external and adjacent the conduits 136, 140. In this manner, the conduits 136, 140 and surrounding air also function as part of the heat exchange system.

Upon completion of the mixing process, the final coating product can then be removed from the mixing reservoir 104. In the illustrated embodiment, a three-way valve 164 is installed on the return line 140 to divert flow from the return line 140 into a conduit 168. The conduit 168 delivers the diverted flow to a suitable storage container 172. Alternatively, the mixing reservoir 104 can include a drain to facilitate removal of the final product from the mixing reservoir 104. In yet other embodiments, the sonotrode 116 can be upwardly and downwardly translatable such that when the sonotrode 116 is translatably raised out of the mixing reservoir 104, the mixing reservoir 104 can be moved out from under the sonotrode 116 and the support or table 160 to which the source 108 and sonotrode 116 are coupled. The contents from the mixing reservoir 104 can then be emptied, for example, by pouring or siphoning.

FIGS. 3 and 4 illustrate a system 200 embodying several aspects of the invention. As shown, the system 200 includes a vortex generator or mechanical agitator 276, which facilitates mixing of the various coating components within the reservoir 204.

The mixing reservoir 204 can include an upper portion 280 defining an opening 284. In FIGS. 3 and 4, the opening 284 is shown sealed or closed which allows the system 200 to be placed under a vacuum. When opened, however, the opening 284 facilitates material addition to and/or internal inspection of (visual, temperature, product sampling, etc.) the mixing reservoir 204.

The mixing reservoir 204 can also include a hinged door 288 (shown in an opened position in FIGS. 3 and 4). When opened, the hinged door 288 allows access to the interior chamber of the mixing reservoir 204, for example, for cleanout and maintenance of the interior chamber.

A powder hopper 208, which preferably includes an Iris valve and ram, is provided to supply additives (e.g., pigment particles, etc.) to the mixing vessel 204. Preferably, the additives are allowed to degas before they are admixed into the reservoir 204.

The system 200 also includes an ultrasonic disperser 212 for ultrasonically dispersing and mixing the additive with the other coating component(s) within the mixing reservoir 204. The system 200 further includes a closed loop heat exchanger 228 for actively cooling a mixture of the additive and coating component. The active cooling allows the additive/coating component mixture to be preferably maintained within a desired temperature range.

In another form, the invention provides methods of producing coatings, such as paint. In one embodiment, the method generally includes receiving a coating component (e.g., binder, solvent, resin, resin carrier, a combination thereof, etc.) within a mixing reservoir, receiving an additive (e.g., pigment particles, colorants, a combination thereof, etc.) within the mixing reservoir, ultrasonically dispersing the additive with the coating component within the mixing reservoir, and actively cooling a mixture of the additive and coating component by allowing thermal energy transfer therefrom. The active cooling allows the mixture to be preferably maintained within a desired temperature range.

Accordingly, embodiments of the invention are capable of dispersing pigment particles and other additives with little to no alteration or degradation of the morphology or desired function of the additives. Various embodiments are suitable for use with special fillers and sensitive or delicate high performance pigments, such as mechanically fragile particles (e.g., materials prone to damage by high shear methods), nanoparticle assemblies, and incompatible particle/resin surface energy.

As described above, various embodiments also include vacuum de-aeration of high surface area fillers, closed loop fluid recirculation, generally precise temperature control, and scalable batches up to relatively high volumes. Various embodiments can also reduce processing time, eliminate (or at least reduce) the need for surface active wetting agents, and increase the coloring power of colorants.

Embodiments of the invention are applicable to a wide range of coatings including paints, varnishes, primers, appliqués, protective coatings, corrosive resistant coatings, organic coatings, inorganic coatings, sol coatings, convertible coatings, nonconvertible coatings, among others. Accordingly, the specific references to coating herein should not be construed as limiting the scope of the present invention to only one specific form/type of coating or to particular types of coating components.

In addition, embodiments of the invention can produce coatings having any number (i.e., one or more) of a wide range of additives (e.g., colorants, pigment particles, primary pigments, secondary pigments, extender pigments, fillers, resins, surfactants, dispersants, thin film metal particulates, etc.). Such additive can be designed to give a surface desired physical properties (e.g., gloss, color, reflectivity, or combinations thereof, etc.) and/or to serve a special or functional purpose (e.g., thermal protection, corrosion resistance, signature reduction, rain erosion protection, resin reinforcement, viscosity control, priming the surface to take a decorative coating, etc.).

Further, embodiments of the invention can produce coatings formed from various base materials, carriers, vehicles, binders (e.g., latex, alkyd, two-component binders, etc.), resins, paint matrixes, paint bases (e.g., water, latex-based materials, oils, etc.).

By way of example, embodiments can be used with any of the thin film metal particulates, pigments, binders, and coatings described in U.S. Pat. No. 6,191,248. By way of further example, embodiments can be used to produce an appliqué such as that described in U.S. Pat. No. 6,177,189. Additional embodiments can be used with any of the materials described in the paper: Stoffer, et al. "Ultrasonic Dispersion of Pigment in Water Based Paints," Journal of Coatings Technology, Volume 63, Number 797, June 1991. The contents of Boeing's U.S. Pat. Nos. 6,191,248 and 6,177,189 and the Stoffer paper are incorporated herein by reference in their entirety as if fully set forth herein.

While various preferred embodiments have been described, those skilled in the art will recognize modifications or variations which might be made without departing from the inventive concept. The examples illustrate the invention and are not intended to limit it. Therefore, the description and claims should be interpreted liberally with only such limitation as is necessary in view of the pertinent prior art.

What is claimed is:

1. A method of producing a coating, the method comprising:

receiving a coating component within a mixing reservoir;

receiving an additive within the mixing reservoir;

ultrasonically dispersing the additive with the coating component within the mixing reservoir;

actively cooling a mixture of the additive and coating component by receiving from the mixing reservoir at least a portion of the mixture within a heat exchanger of a cooling loop;

urging the mixture from the heat exchanaer to a valve of the cooling loop;

diverting at least a portion of the mixture having a temperature within a desired temperature range from the valve to a storage container; and returning to the mixing reservoir any portion of the mixture not diverted from the valve.

2. The method of claim 1, wherein the actively cooling comprises maintaining the mixture within a desired temperature range.

3. The method of claim 2, wherein the cooling loop is configured for maintaining the mixture at approximately 70 degrees Fahrenheit.

4. The method of claim 1, wherein the actively cooling comprises transferring from the mixture a substantial entirety of the thermal energy produced by the ultrasonic dispersing.

5. The method of claim 1, further comprising mechanically agitating the mixture.

6. The method of claim 1, further comprising:

reducing pressure within the mixing reservoir; and maintaining the mixing reservoir at the reduced pressure.

7. The method of claim 6, wherein the reducing and maintaining comprises placing the mixing reservoir under a vacuum of at least about 29" Hg.

8. The method of claim 6, wherein the reducing and maintaining includes using a vacuum pump operatively connected to the mixing reservoir.

9. The method of claim 6, wherein the reducing and maintaining includes receiving fluid from a fluid source within at least one venturi nozzle of a venturi vacuum generator operatively connected to the mixing reservoir.

10. The method of claim 1, further comprising degassing the additive before receiving the additive within the mixing reservoir.

11. The method of claim 1, wherein the actively cooling comprises:

receiving the mixture within a heat exchange coil at least partially positioned within a fluid to cool the mixture by thermal energy transfer from the mixture to the fluid; and returning the mixture from the heat exchange coil to the mixing reservoir.

12. The method of claim 1, wherein the ultrasonically dispersing comprises:

positioning a sonotrode within the mixing reservoir; and applying energy to the sonotrode to generate ultrasonic energy which propagates through the base within the mixing reservoir.

13. The method of claim 1, wherein the receiving an additive within the mixing reservoir comprises receiving pigment particles within the mixing reservoir.

14. The method of claim 12, wherein the additive is received within the mixing reservoir after applying energy to the sonotrode.

15. The method of claim 12, wherein the cooling loop is configured and sized according to ultrasonic energy input from the sonotrode.

16. The method of claim 12, wherein positioning a sonotrode within the mixing reservoir including translating the sonotrode relative to the mixing reservoir to position at least a distal end portion of the sonotrode for immersion within the mixing reservoir.

17. The method of claim 1, wherein the receiving a coating component within a mixing reservoir comprises receiving a binder within the mixing reservoir.

18. The method of claim 1, wherein the receiving a coating component within a mixing reservoir comprises receiving a solvent within the mixing reservoir.

19. The method of claim 1, wherein the receiving a coating component within a mixing reservoir comprises receiving a resin carrier within the mixing reservoir.

20. The method of claim 1, wherein the mixture can be cooled to a temperature within a desired temperature range by controllably varying the flow rate of the mixture through the cooling loop.

21. The method of claim 20, wherein the flow rate of the mixture through the cooling loop and the time and amplitude of the ultrasonic dispersion is controlled under automatic computer control.

22. The method of claim 20, wherein the cooling loop is configured to cool the mixture to approximately 70 degrees Fahrenheit.

23. The method of claim 1, further comprising positioning a disposable liner within the mixing reservoir before receiving the coating component and the additive within the mixing reservoir, to thereby inhibit the coating component and the additive from directly contacting the mixing reservoir.

24. The method of claim 23, further comprising removing the disposable liner from the mixing reservoir after removal of the mixture from the mixing reservoir.

25. The method of claim 1, wherein receiving an additive within the mixing reservoir includes receiving the additive from an additive source comprising at least one or more of a hopper, a filler tube, and a powder hopper with an Iris valve and ram.

26. The method of claim 1, wherein the actively cooling comprises receiving the mixture within a heat exchange coil immersed within a coolant to cool the mixture by thermal energy transfer from the mixture to the coolant.

27. The method of claim 26, wherein the coolant comprises an ethylene glycol/water mixture having a temperature between about negative 2 degrees Celsius and 2 degrees Celsius.

28. The method of claim 26, further comprising recovering heat from the coolant as process heat.

29. The method of claim 1, further comprising removing at least a portion of the mixture from the mixing reservoir by at least one or more of draining, siphoning, and pouring from the mixing reservoir.

30. The method of claim 1, further comprising opening a hinged door of the mixing reservoir to obtain access to the interior chamber of the mixing reservoir.

* * * * *